United States Patent [19]

Saunders

[11] Patent Number: 4,965,938

[45] Date of Patent: Oct. 30, 1990

[54] RESISTIVELY-MOUNTED, MANUALLY-POSITIONABLE PEEP SIGHT

[75] Inventor: Charles A. Saunders, Columbus, Nebr.

[73] Assignee: Saunders Archery Company, Columbus, Nebr.

[21] Appl. No.: 467,923

[22] Filed: Jan. 22, 1990

[51] Int. Cl.[5] ..... F41G 1/467

[52] U.S. Cl. ..... 33/265; 124/87

[58] Field of Search ..... 33/265; 124/87, 90

[56] References Cited

U.S. PATENT DOCUMENTS

| | | | |
|---|---|---|---|
| 3,410,644 | 11/1968 | McLendon | 33/265 |
| 3,703,770 | 11/1972 | Sofield | 33/265 |
| 3,703,771 | 11/1972 | Saunders | 33/265 |
| 4,116,194 | 9/1978 | Topel | 124/87 |
| 4,454,857 | 6/1984 | Miller et al. | 124/87 |
| 4,552,121 | 11/1985 | Treaster | 124/87 |
| 4,563,821 | 1/1986 | Saunders | 33/265 |
| 4,625,422 | 12/1986 | Carlson | 33/265 |
| 4,656,746 | 4/1987 | Gillespie | 33/265 |
| 4,656,747 | 4/1987 | Troncoso | 33/265 |

*Primary Examiner*—Thomas B. Will

*Attorney, Agent, or Firm*—Michael G. Berkman

[57] ABSTRACT

A peep sight for mounting on the bowstring of an archery bow. The peep sight is resistively and frictionally stably mounted on and coupled to the bowstring, yet readily, manually relocatable at selected positions along the bowstring. In a specific embodiment of the invention, the peep sight body is formed with longitudinally extending channels at opposed sides thereof, each of the channels entraining therewithin an array of strands constituting divided grouped arrays of the bowstring. Bearing on and held fixed with respect to the body of the peep sight at opposed ends thereof are bowstring-engaging elements for embracing the bowstring and establishing, in conjunction with the peep sight body, a frictional securement of the peep sight on the bowstring in selectable locations therealong, thus obviating the need for windings, or wrapping or serving as means for fastening the peep sight on the bowstring.

7 Claims, 2 Drawing Sheets

RESISTIVELY-MOUNTED, MANUALLY-POSITIONABLE PEEP SIGHT

FIELD AND BACKGROUND OF THE INVENTION

The present invention relates to peep sights for use with an archery bow. More particularly, the invention is directed to a peep sight which is frictionally and stably held in place at selectable positions on the bowstring, yet is readily manually repositionable as may be required or desired in use.

Peep sights of many different constructions are known in the art. These peep sights have taken various forms and configurations, for accommodating and for use with both simple bows and compound bows. For the most part these devices have been mounted on the bowstring by fixedly attaching them with the expedient of wrappings, bindings or serving. Resort to this type of mechanical fastener requires considerable time and calls for more than casual skill to ensure proper affixation of the bowstring. Moreover, resulting prior art structures render it necessary to remove and then to rewind the securing wrapping each time one desires to relocate the peep sight for the purpose of correcting or varying the sighting characteristics. Tedious repetition of the attaching procedure is ordinarily quite unavoidable if one is finally to set and later to reset the peep sight in a precisely and properly calibrated mode.

While the desirability of being able simply to attach and to detach (for repositioning) and reattach the peep sights to bowstrings has long been recognized, no simple and completely satisfactory structure for so doing has been realized. It is, therefore, a principal aim of the present invention to provide a peep sight which may be quickly and easily fastened on a bowstring, which is positively reliably affixed in place, and which may also be readily repositioned without the use of bindings, wrappings, servings or other mechanical expedients, and which cures many of the shortcomings of prior art devices.

SUMMARY OF THE INVENTION

The peep sight of the present invention is characterized in that it is structured so as to be resistively and frictionally and stably mounted on and coupled to a bowstring, yet readily manually relocatable to selectable new positions along the bowstring—all without the use of auxiliary wrappings, bindings, or servings, and without the use of tools or adhesives.

It is a principal feature of the peep sight of the invention that while resisting and stabilized against inadvertent displacement, it is forcibly slidably shiftable along the bowstring for desired repositioning.

In a preferred embodiment of the invention the peep sight includes a block-like body to which there is secured, to extend upwardly and downwardly from the body, upper and lower coupling elements for engaging the bowstring for mounting the peep sight thereon.

It is a feature of the peep sight of the invention that the coupling elements for fastening the peep sights on the bowstring are operatively effective to retain the peep sight in selectable positions along the length of the bowstring without the use of auxiliary structures.

Yet another feature of the peep sight of the invention is that frictional forces established between the peep sight and the bowstring are the forces by which the peep sight is held in place on the bowstring.

In a preferred embodiment of the invention the peep sight is provided with bowstring-engaging elements which are in the form of convoluted, longitudinally-extending, ellipsoidal segments attached to the body of the peep sights and defining a tubular passageway extending coaxially within each segment for threaded lineal passage of the bowstring therethrough.

It is a related feature of the peep sight of the invention that it includes a block-like body formed on each of its opposed lateral sides with longitudinally extending, channel-like grooves for receiving divided strands of the bowstring, the strands then converging to pass lengthwise through elongated, convoluted ellipsoidal segments projecting from each of upper and lower extremities of the peep sight body.

In one specific embodiment of the invention the convoluted ellipsoidal segments defining the passageway traversed by the bowstring are joined to one another by an integrally-formed, yoke including a wire-like linearly-extending mid-section, the latter being seated within a vertically extending groove formed in a lateral face of the body of the peep sight.

Yet another feature of the invention is that the peep sight is formed with a core disposed between side grooves in the body of the peep sight, the divided strands or bowstring arrays of the bowstring being entrained within the grooves to embrace and stressingly to bear upon the core, thus obviating inadvertent shifting displacement of the peep sight assembly in archery use.

A related feature of the peep sight is that the core defines, at an upper end thereof spacer means for restraining and maintaining divided arrays of strands of the bowstring in a laterally spread and spaced-apart configuration to establish between the arrays a zonal viewing area defining an opening which is in operational alignment with a sighting aperture in the body of the peep sight to delineate a viewing vector when sighting on a target.

An additional feature of the peep sight of the invention is that an upper longitudinally extending ellipsoidal segment of the bowstring-intercoupling device terminates in an upwardly directly arm to which a peep sight stabilizing and orienting, flexible tether line is connected. At its other end, the tether line is fastened to a bow limb, or, in the case of a compound bow, to one of the strings other than the bowstring on which an arrow is nocked.

Yet another feature of the invention is that the body of the peep sight is formed with a wing or plate-like flange joined to and extending upwardly of a core of the body of the peep sight, a through viewing aperture being formed in the wing and disposed normally of a principal face thereof.

In a preferred embodiment of the invention each ellipsoidal segment of the bowstring intercoupling means of the peep sight includes, at a free end thereof, a projecting extension by which the segment may be grasped to facilitate the winding of the bowstring onto the convolutes of the ellipsoidal segment.

A related feature of the invention is that there is provided a bowstring-intercoupling yoke which is a unitary structure fabricated of wire or of a similar material and including spaced upper and lower ellipsoidal segments and an intermediate, straight middle section, the latter bridging the body of the peep sight.

Other and further objects, features and advantages of the invention will be understood from a reading of the following description considered in conjunction with the drawings.

DETAILED DESCRIPTION OF THE ILLUSTRATED EMBODIMENT

The aims and objects of the invention are achieved by providing an assembly which includes, in cooperating combination, a peep sight body and a cradle-like or yoke-like fixture for fixedly yet manipulatively mounting the peep sight body on a supporting bowstring. The peep sight body has a sighting aperture and is formed with side channels for receiving divided arrays of tensioned, body-gripping strands of the bowstring.

A bowstring-embracing fixture brackets the body of the peep sight and shiftably secures the body of the peep sight on the bowstring, the fixture itself including a straight wire portion seating within a longitudinally extending side channel or groove in the peep sight body. The fixture is formed at each of opposed ends of the straight wire with convoluted, ellipsoidal segments demarking passageways through which upwardly and downwardly directed peep-sight-embracing strands of the bowstring are threaded.

The free ends of the ellipsoidal segments of the fixture are joined to integrally formed arms or arm-like extensions each projecting away from the body of the peep sight. The arms are conveniently grasped and manipulated about the bowstring in attaching the fixture to and in detaching the fixture from the bowstring. Additionally, the upper arm constitutes an anchor element to which a tether for stabilizing and orienting the peep sight may be connected.

Figure 2:
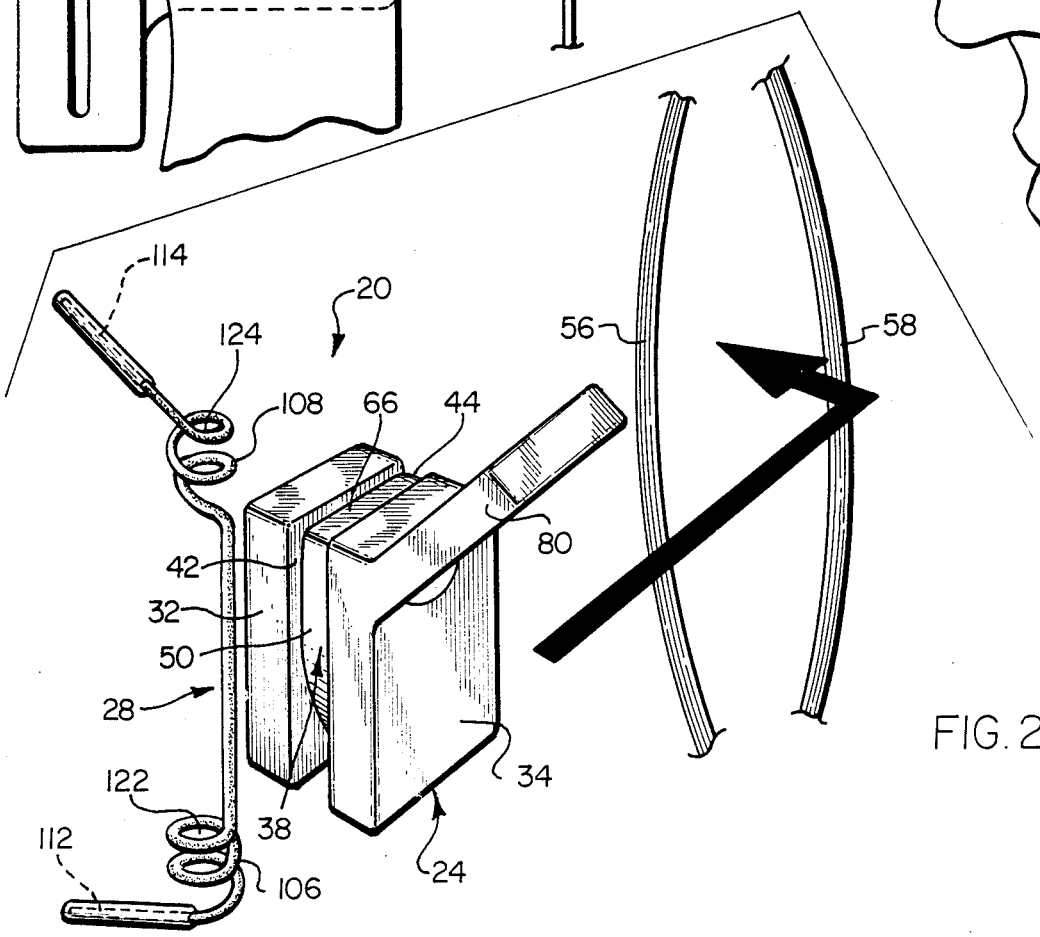
FIG. 2 is an exploded view showing the component elements of the peep sight of the invention and indicating schematically the manner of attachment of the sight by dividing and separating the strands of a bowstring.

Referring now more particularly to the drawing, for purposes of disclosure and not in any limiting sense, a preferred embodiment of the peep sight of the invention is shown as an assembly 20 including a generally block-like body 24 and a high-mechanical strength, flexible yet firm fixture or yoke 28 fabricated of high tensile strength wire. As shown in FIG. 2, the body 24 includes front and rear walls 32 and 34 spaced apart by a recessed, intermediate core 38 to form a pair of channel-like grooves 42 and 44 at each of opposed lateral walls 50 and 52 of the core 38. The grooves 42 and 44 are sized to received therewithin band-arrays 56 and 58 of divided and separated strands of a multi-stranded bowstring 62 as indicated schematically in FIG. 2 and as clearly shown in FIGS. 3 and 6.

Figure 3:
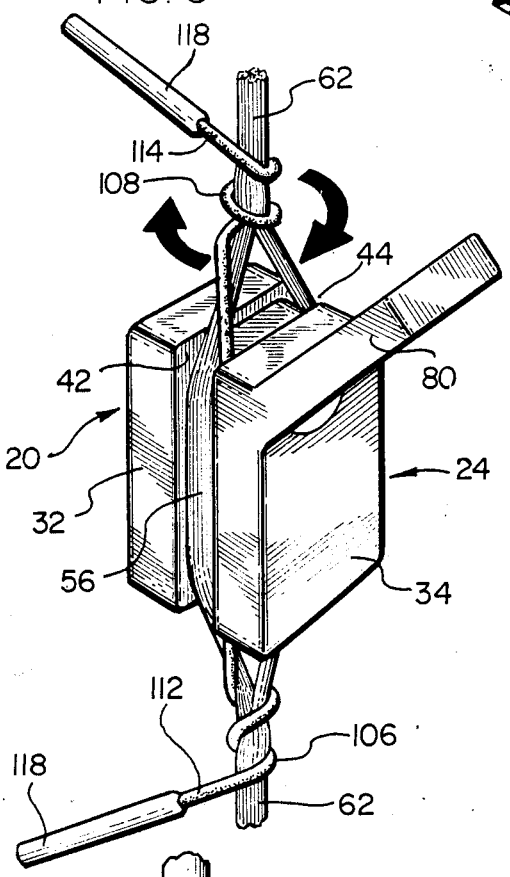
FIG. 3 is a perspective view of the bowstring-mounted peep sight of the invention, with the separated strands as arrays guided through the ellipsoidal ends of the mounting wire, and the divided strands embracing the body of the peep sight.
Figure 6:
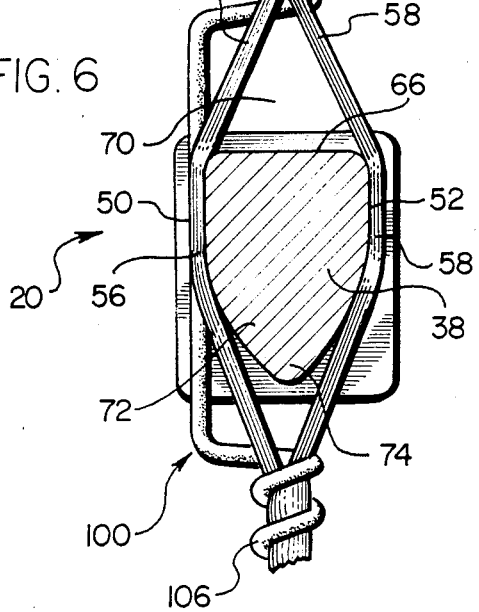
FIG. 6 is a vertical, cross-sectional view taken substantially on the lines 6—6 of FIG. 4, and showing the divided bowstring strands trained about and embracing the core of the block of the peep sight.

The core 38 is shaped to provide a substantial width at its upper end 66 so as to hold apart the bowstring arrays 56 and 58, thereby to provide an open zonal area 70 for sighting therethrough (FIGS. 3 and 6). At its lower end 72 the core 38 tapers inwardly to form a downwardly projecting smooth apex or tip 74 facilitating forced sliding movement and displacement of the body 24 of the peep sight along the bowstring 62, when one desires to reposition the peep sight assembly on the bowstring 62.

Figure 1:
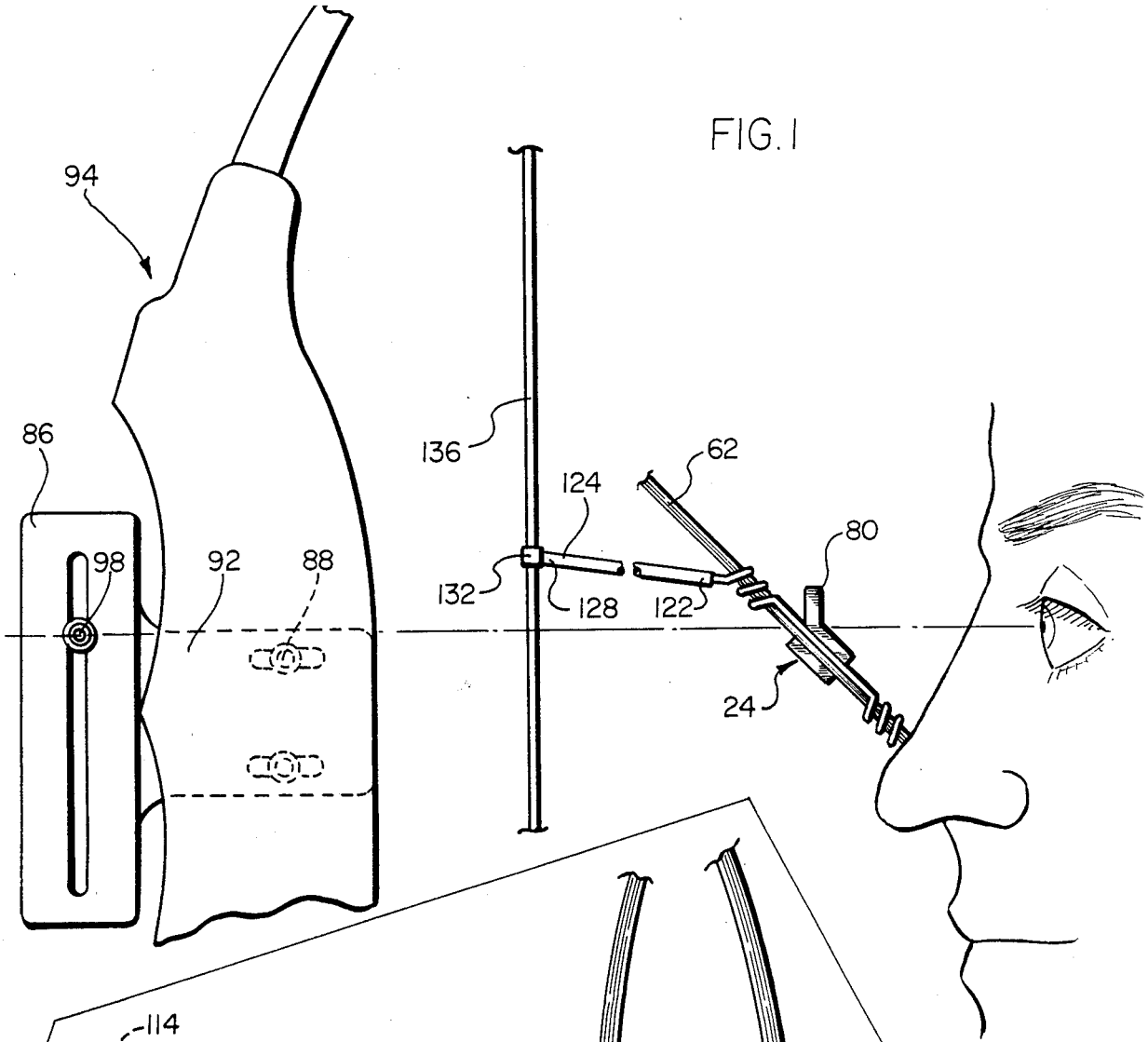
FIG. 1 is a fragmentary, side view indicating schematically the manner in which an archer sights through the bowstring-carried peep sight of the invention.
Figure 4:
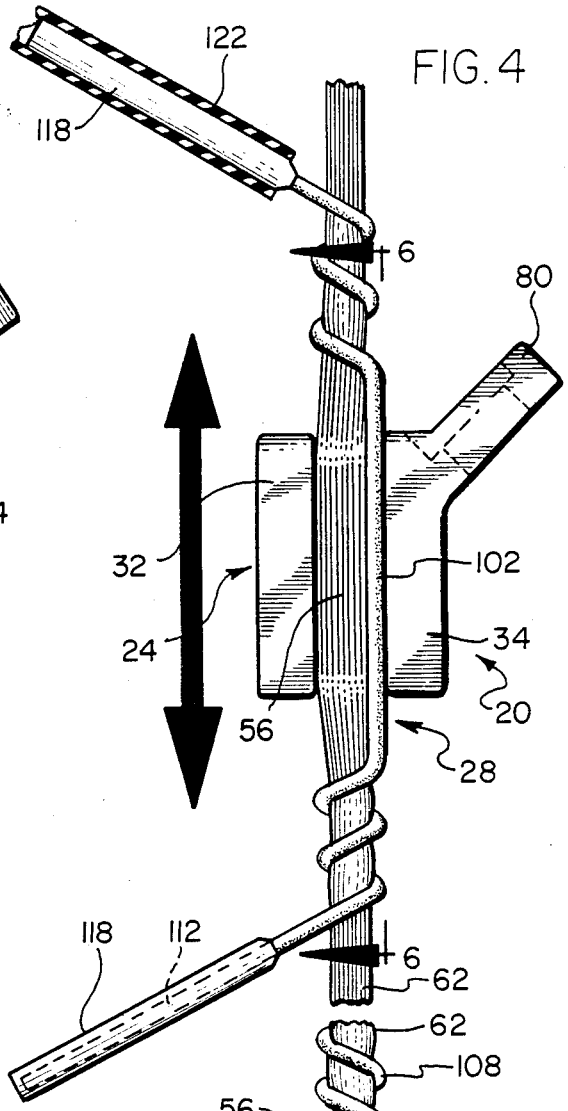
FIG. 4 is a side elevational view showing the peep sight mounted on the bowstring for adjustable up and down positioning therealong.
Figure 5:
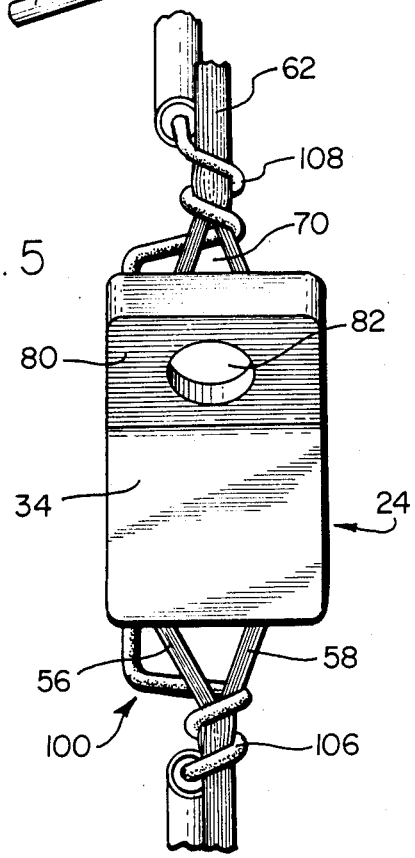
FIG. 5 is an elevational view of the bowstring-mounted peep sight as seen by the archer.

As shown in FIGS. 2, 3 and 4, the body 24 of the peep sight includes a flange or wing 80 which is joined and extends upwardly and rearwardly from a rear wall 34 of the main portion of the body 24. As best seen in FIG. 5, the wing 80 is formed with a through viewing aperture 82 which, during use of the peep sight, is in alignment with the open zonal area 70 demarked by the upper edge 66 of the core 38 and the bridging band arrays 56 and 58 of the bowstring 62. The arrangement described provides a sighting course through which the archer can see a bow sight 86 mounted 88 in the window zone 92 of an archery bow 94, and can see any selected sight bar, ring or pin 98, as indicated schematically in FIG. 1.

A preferred embodiment of the fixture 28 by means of which the peep sight is mounted on the bowstring 62 is, as shown in FIG. 2, fabricated of wire and includes a core-engaging yoke 100 having a straight mid-section 102. The yoke 100 is formed at each of its opposed ends with convoluted, longitudinally extending, ellipsoidal segments 106 and 108 terminating in arms 112 and 114 preferably coated with a plastisol composition 118 or similar preparation.

The various functions or functional roles of the several components of the fixture 28 are evident upon a consideration of the drawings. As the yoke 100 embraces the core 38, its straight mid-section or wire 102 seats in one 42 of the grooves formed in the body of the peep sight, sharing that groove 42 with one 56 of the strand arrays produced by dividing the strands of the bowstring 62 into two groups or arrays 56 and 58 (FIGS. 3 and 4). The convoluted, ellipsoidal segments 106 and 108 define elongated, coaxial passageways 122 and 124 through which the divided, and then the reunited strand arrays 56 and 58, pass at each of opposed ends of the peep sight body 24 (FIGS. 3 and 6). The peep sight assembly 20 is thus string-mounted, as shown in FIGS. 3–6.

In practice, the attachment of the peep sight to provide an assembly which is slideable upwardly and downwardly on the bowstring 62 to assume selectable positions is a simple procedure. It is carried out most expeditiously on a unstrung bowstring.

The strands of the bowstring 62 are first divided into two equal groups or arrays 56 and 58 between which the core 38 of the body 24 of the peep sight is then inserted so that the strand arrays seat in the channels 42 and 44. While holding the yoke 100 in place with the straight mid-section 102 seated in a side channel 42, the bowstring is wound about each of the convoluted coils at one end of the yoke 100, beginning with the convolute turn adjacent the yoke. With that operation completed, the bowstring occupies and extends through the passage 122 defined by the elongated coil or convolute 106. The same process of winding the bowstring 62 is repeated at the other coil 108 at the opposite end of the yoke 100. The bowstring 62 is now encoupled with the fixture 28 and with the body 24 of the peep sight. The bow may then be conveniently strung.

In order to align and to restrain the peep sight in a functional disposition, with the wing 80 and its aperture presented to the archer, the upper arm 114 of the fixture 28 is connected to one end 12 of a flexible and resilient tether line 124 or length of rubber tubing. An opposite end 128 of the tubing 124 is fastened, for example by oversleeving, onto an anchor post 132 which is in turn fastened to a string 136 of a compound bow 94.

In accordance with the practice of the present invention, both minor as well as substantial correctional changes and calibrations may be simply and readily made in the sighting system. All that is required, in order to modify or correct the sighting system, is manually forcibly to slide the peep sight assembly (either up or down) along the bowstring to a new location. While frictional forces imposed on the assembly by the tensioned bowstring serve effectively to hold the assembly fixed against and to resist casual and inadvertent displacement, these frictional forces and inertia are conveniently overcome by purposeful application of manual force. All adjustments involving repositioning of the peep sight are achieved without disruption of the securement of the peep sight on the bowstring, and without the use of tools of any type.

What is claimed is:

1. A peep sight for mounting on a bowstring of an archery bow, said peep sight comprising, a generally block-like body, said body including wing means joined to and angled upwardly and rearwardly, said wing means being formed with through aperture means in a target-facing portion thereof for sighting therethrough along a line essentially normally of a principal face of said wing means, said body having a forward wall spaced from a rear wall, and an intermediate, interconnecting core interposed therebetween, said core being recessed with respect to lateral limits of said forward and said rear wall, said forward and said rear wall defining therebetween, and with lateral walls bounding said core, opposed generally-parallel, longitudinally extending, channel-like grooves opening laterally of and opening endwise of said core, each of said grooves being adapted to receive therein and restrictingly to retain at each of opposed corresponding said lateral walls of said core a band-like array of divided strands of a multi-stranded bowstring, said strands of each said array being trained within respective said grooves and about said core for stressed engagement therewith, said strands continuing upwardly and downwardly beyond said core and beyond said body of said peep sight, fixture means for mounting said peep sight on the bowstring, said fixture means including mid-section wire means for engaging said body of said peep sight, said wire means being connected at upper and lower ends thereof to a convoluted, longitudinally-extending, ellipsoidal segment, each said ellipsoidal segment defining passageway means bounded by and extending within said convoluted segment for accommodating a portion of the bowstring threaded therethrough, arm means joined to at least one said ellipsoidal segment at an end thereof and extending from said ellipsoidal segment for attachment of tether line means thereto for stabilizing and for positionally restraining said peep sight in a functionally efficaucious attitude, an upper said elipsoidal segment of said fixture means extending from a zone displaced upwardly of said sighting aperture means of said peep sight, said core of said body of said peep sight defining at an upper end portion thereof spacer means disposed between the divided strands of the bowstring for restraining and for maintaining the divided strands in a laterally-spaced-apart configuration to establish between the divided strands a throughviewing zonal area, said zonal area being in alignment with said sighting aperture means in said wing means of said body of said peep sight to delineate a viewing vector when sighting on a target, said peep sight together with said fixture means being forcibly manually shiftable along the bowstring, against inertial and frictional forces established between the bowstring and each said ellipsoidal segment of said fixture and said core of said body of said peep sight, said forces being operative to restrain said peep sight from casual and inadvertent and unintentional sliding movement along the bowstring, said peep sight being conveniently manually displaceable to assume selectable positions on the bowstring along the length thereof, said bowstring-engaging ellipsoidal segments constituting means for obviating any need to apply wrapping to and to remove wrapping from the bowstring in a zone delineated by said peep sight.

2. The structure as set forth in claim 1 wherein said mid-section wire means of said fixture means comprises substantially-straight wire means for seating in one of said grooves of said body of said peep sight, and wherein said ellipsoidal segment is integrally formed with said wire means as an extension thereof.

3. The structure as set forth in claim 1 wherein the bow is a compound bow, and further comprising flexible tether line means having one end attached to said arm means of said peep sight at a free end of said ellipsoidal segment, said tether line means extending upwardly from said arm means to a string of the compound bow, the string being between an arrow engaging bowstring and a frame of the compound bow, means securing a free end of said tether line means to the string for maintaining the bowstring-carried said peep sight in an alignment attitude facilitating the sighting through said aperture in said wing means of said body of said peep sight.

4. The structure as set forth in claim 1 wherein said arm means extends from a free end of each said ellipsoidal segment, said arm means comprising means adapted to be gripped manually for rotating said convolutes of said ellipsoidal segment about the bowstring for mounting the peep sight on the bowstring.

5. The structure as set forth in claim 4 and further comprising sleeve means overlying and embracing said arm means and bonded thereto for facilitating and for enhancing gripping of said arm means.

6. The structure as set forth in claim 5 wherein said sleeve means are formed of a non-metal material.

7. The structure as set forth in claim 1, wherein each said ellipsoidal segment comprises means for guided insertion of the bowstring laterally therewithin and for obviating a requirement to detach the bowstring from the bow prior to affixing said bowsight functionally in position on the bowstring.

* * * * *